US008514037B2

(12) United States Patent
Hsu et al.

(10) Patent No.: US 8,514,037 B2
(45) Date of Patent: Aug. 20, 2013

(54) DUAL BIPOLAR MAGNETIC FIELD FOR ROTARY HIGH-VOLTAGE CONTACTOR IN AUTOMOTIVE LITHIUM-ION BATTERY SYSTEMS

(75) Inventors: Chih-Cheng Hsu, Rochester Hills, MI (US); Andrew J. Namou, Southfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 38 days.

(21) Appl. No.: 13/113,488

(22) Filed: May 23, 2011

(65) Prior Publication Data

US 2012/0181953 A1 Jul. 19, 2012

Related U.S. Application Data

(60) Provisional application No. 61/432,811, filed on Jan. 14, 2011.

(51) Int. Cl.
*H01H 67/06* (2006.01)
*H01H 67/02* (2006.01)

(52) U.S. Cl.
USPC ..... 335/125; 335/30; 335/68; 335/71; 335/73; 335/107; 335/118; 335/133; 335/189; 335/190; 335/200; 335/201

(58) Field of Classification Search
USPC ..... 335/128, 201, 15, 30, 57, 65, 68, 335/71, 73, 107, 114, 133, 189–191, 200, 335/125, 118
See application file for complete search history.

(56) References Cited

U.S. PATENT DOCUMENTS

| | | | | |
|---|---|---|---|---|
| 1,763,003 | A * | 6/1930 | Mead | 335/125 |
| 2,575,060 | A * | 11/1951 | Matthias | 218/25 |
| 2,952,755 | A * | 9/1960 | Brinker et al. | 335/125 |
| 3,573,812 | A * | 4/1971 | Pihl | 340/815.63 |
| 5,548,259 | A * | 8/1996 | Ide et al. | 335/78 |
| 6,026,921 | A * | 2/2000 | Aoyama et al. | 180/65.25 |
| 6,700,466 | B1 * | 3/2004 | Yamamoto et al. | 335/132 |
| 2010/0243197 | A1 * | 9/2010 | Osborne et al. | 164/520 |
| 2012/0181860 | A1 * | 7/2012 | Hsu et al. | 307/10.1 |

FOREIGN PATENT DOCUMENTS

| | | |
|---|---|---|
| JP | 2003-272499 | 9/2003 |
| JP | 2004-111313 | 4/2004 |
| WO | 2009116493 A1 | 9/2009 |

* cited by examiner

*Primary Examiner* — Mohamad Musleh

(57) ABSTRACT

A device and method for operating automotive battery system relays and related switches. By aligning a magnetic field with a direction of current flow in a contact plate disposed between magnets that are producing the field, a generated Lorentz force can be used to promote arc extinguishing during a relay opening sequence, while simultaneously reducing the tendency of the Lorentz forces to interfere with the operation of a solenoid or other switch-activating mechanisms. By using a rotary-based mechanism to establish contact between a contact plate and current-carrying terminals, the likelihood of inadvertent opening of the relay is reduced. Such devices and methods may be used in conjunction with hybrid-powered and electric-powered vehicles.

6 Claims, 7 Drawing Sheets

DUAL BIPOLAR MAGNETIC FIELD FOR ROTARY HIGH-VOLTAGE CONTACTOR IN AUTOMOTIVE LITHIUM-ION BATTERY SYSTEMS

This application claims the benefit of the filing date of U.S. Provisional Application No. 61/432,811, filed Jan. 14, 2011.

BACKGROUND OF THE INVENTION

This invention relates generally to a device and method to reduce the magnitude of a Lorentz force formed on solenoid-based rotary contact plate, and more particularly to a device and method to reduce such magnitude while maintaining arc-extinguish features when the contact plate is opened or otherwise de-energized.

Solenoids are often used to open and close relays, switches and related electrical circuit contacts. Moreover, solenoids may be of a generally linear configuration or a rotary configuration. In either configuration, a high-voltage contactor employs the solenoid to move a contact plate into selective connection with a pair of stationary current-carrying terminals to complete an electrical circuit between the terminals. The contact is open when the solenoid is de-energized, and closed (or completed) when the solenoid is energized. In the particular configuration associated with a rotary solenoid, the solenoid's plunger or shaft rotates clockwise or counter-clockwise, depending on whether the solenoid is energized or de-energized. The contact-plate that attaches to the plunger will likewise rotate such that in an energized solenoid state, the contact plate will close the circuit between the two terminals, while in a de-energized solenoid state, the contact plate will open the circuit between the two terminals.

The presence of high voltage and current can cause arcing between the contact plate and the terminals at the time immediately after separation. Such arcing is not desirable, especially in high current modes of operation, as the power created by the arc tends to get absorbed by (or otherwise acts upon) nearby components that may not be electrically hardened.

Attempts to reduce or extinguish the arc have included enclosing the contact plate and terminals inside a chamber filled with a dielectric gas that introduces arc-inhibiting features by absorbing some of the energy during the arc formation. Such a configuration also reduces the packaging and provides some level of environment-independent usage. Despite this advantage, such a solution has a disadvantage in device cost and complexity.

In another attempt, supplemental magnet pairs have been placed on opposing sides of the contact plate and terminals to take advantage of the Lorentz force acting upon the terminals or other current-carrying members that are exposed to the magnetic field. The inherent Lorentz force can be used in the instant immediately after the circuit is opened at the contact plate to accelerate arc elimination by taking advantage of the arc's polarity and stretching it over a larger region. Such an approach is generally satisfactory for helping to extinguish the arc. Unfortunately, the Lorentz force produced by the supplemental magnets is also imparted onto the nearby contact plate during normal closed-circuit operation. Because this force (which by virtue of the orientation of the magnets relative to the current flowing through the contact plate is generally in a direction that could promote premature separation of the contact plate from the terminals) can interfere with the operation of the solenoid in general and the contact plate in specific, there remain ways in which solenoid operation may be improved.

Lithium-ion batteries are being used to provide partial (in the case of hybrid system) or total (in the case of all-electric systems) motive power for automotive applications. Significant levels of one or both voltage and current are needed to provide electrical power to a motor that in turn can provide propulsive power to a set of wheels. The high levels of electrical power employed by such battery systems could, if left uncorrected, lead to significant arcing during relay and related switch operation. In systems that employ some form of magnet-based arc-extinguishing feature (such as that discussed above), Lorentz forces induced by the magnetic fields are large enough to interfere with the plates and contacts of conventional relay and related switch assemblies by moving them to a different degree (or at a different time) than that for which they were designed. In particular, a downwardly-directed Lorentz force may overcome the bias established by the induced magnetic force on the solenoid's plunger, which in turn could cause inadvertent opening of the contacts and the formation of the very arcing that the supplemental magnets were included to avoid. This untimely contact plate opening may have deleterious effects on the operation of a battery-powered automotive propulsion system.

SUMMARY OF THE INVENTION

According to a first aspect of the invention, a switching assembly is disclosed. In the present context, a switching assembly corresponds to an arrangement of components that together allow for selective opening and closing of an electric circuit. As such, electric current passing through the switching circuit can be used to switch on or off a secondary electric circuit. In one example, such a secondary circuit could be a work-performing circuit configured to deliver electric current from one or more batteries (such as a lithium-ion battery) to an electric motor or other devices that can provide propulsive power for a car, truck or related vehicular or motive application. In particular form, the switching assembly of the present invention may be configured as a relay, switch or related circuit-opening and circuit-closing mechanism. The supplemental magnets used for a relay, switch or related solenoid-based device can be arranged in conjunction with the direction of electric current flow through the terminals and contact plate to reduce the magnitude of the Lorentz force produced by the interaction of the magnetic field and electric current while simultaneously reducing the arcing associated with de-energized contacts. This latter feature, with its reduction in the likelihood of a partially-open contact, promotes more stability in the current path from one terminal to the other. In other words, since the Lorentz force on the contact plate is minimized, the potential for the contact to be inadvertently disconnected from the terminals due to such force is decreased.

The rotary nature of the connection between the solenoid, contact plate and terminals ensures a faster disconnect; this in turn produces a faster elimination of the arcing produced during contact plate and terminal disconnect. Furthermore, the rotary nature of the connection between the solenoid and the contact plate promotes stronger joint potentials and a concomitant increase in device robustness for high-voltage contactors such as those encountered in lithium-ion battery systems. For example, unlike a linear solenoid (where the shaft interacts with the contact plate through a relatively small ball-shaped region, the rotary design may enable a large region of connection that promotes a more durable construction.

As stated above, one advantage of the design is that it prevents the Lorentz force from inadvertently opening the contact between the plate and the terminals during high current pulses. Such prevention is in evidence in situations where the supplemental (i.e., arc-extinguishing or arc-breaking) magnets are placed such that the current and magnetic field are in parallel as shown and described below. In theory, this parallel arrangement of the current flow and the magnetic field equates to complete elimination of the Lorentz force on the contact plate. Importantly, because this force on the contact plate has nothing to do with the arc-breaking effect of the Lorentz force on the area around the connection between the terminals and the contact plate, such arc-breaking force still exists because the current at that location is orthogonal rather than parallel with the magnetic field.

The rotary design according to the present invention may have variations as well. In one variation, the supplemental magnets may, instead of being placed such that the field produced between them is parallel to the flow of electric current through the connected terminals, be placed across the terminals such that the magnetic field is directed in an orthogonal direction to that of the current flowing through the terminals. Under linearly-actuated contact plate configurations (i.e., where the plunger from the solenoid translates under the force of an applied current through the solenoid's coil), such orthogonality between the magnetic field and the current flow through the terminals may promote the Lorentz force problems discussed above, as induced forces could lead to inadvertent opening of the contact between the plate and the terminals during normal operation. Under a variation of the present invention where such orthogonality does exist, a Lorentz force is generated, but nevertheless avoids the contact opening difficulties discussed above because the contact points are oriented in a direction not influenced by the induced force. Under this variation of the design, the supplemental magnet configuration may be left in place in a manner generally similar to that of previous designs, but because of the nature of the rotary contact and the contact plate, the Lorentz force (while not eliminated in the same manner as the design discussed in the previous paragraphs) becomes less likely to interfere with the operation during high current flows while maintaining the arc-extinguishing features of the supplemental magnets during contact opening and closing events.

Optionally, the magnets may be arranged such that a field produced by the plurality of magnets extends in a direction generally parallel to the direction of the electric current such that creation of the Lorentz force onto the contact plate is substantially inhibited. In another option, the field produced by the plurality of magnets extends in a direction generally perpendicular to the direction of the electric current such that the created Lorentz force acts upon the contact plate in the direction that does not substantially promote premature separation of the contact plate from the plurality of terminals. For example, the orientation of the switching assembly may be such that the Lorentz force produced during normal operation current flow through the closed circuit is imparted to the contact plate in a generally downward direction, while the direction of movement of the contact plate defines a generally circular path that is out of the plane of the created Lorentz force; in this way, the Lorentz force brings nothing to bear upon the plate that would either promote or inhibit its movement. In a more particular from, the direction that does not substantially promote premature separation of the contact plate from the plurality of terminals extends substantially along an axis formed by the rotational movement of the plunger.

Each of the above optional configurations has its own advantages. The first embodiment is effective in that by generally aligning the current and field, the generation of the Lorentz force is stunted. Thus, by aligning a magnetic field with a direction of current flow (or opposite of the current flow) in a contact plate disposed between magnets that are producing the field, the tendency of the Lorentz forces to interfere with the operation of a solenoid or other switch-activating mechanisms during normal (i.e., uninterrupted) current flow are precluded, while simultaneously preserving the Lorentz force used to promote arc extinguishing during a relay opening sequence (where the electric current travels in a direction normal to the field as well as the flow of current during routine closed-circuit operation). The second embodiment, even though oriented to leave the Lorentz force in place (by virtue of the generally orthogonal orientation of the current flow and the magnetic field), has more potential to be effectively packaged in a space-saving (i.e., square) configuration. As such, the configuration used will depend on the needs of the automotive or related system into which the particular configuration is placed.

According to another aspect of the invention, a vehicular propulsion system is disclosed. The system includes numerous batteries, a motive force and a switching assembly configured to permit selective delivery of an electric current from the batteries to the motive force. The switching assembly includes a solenoid substantially as described above.

In one optional form, the numerous batteries are lithium-ion batteries. In another preferred form, the motive force is an electric motor that is rotationally coupled to one or more vehicular wheels. A transmission may be used between the electric motor and the one or more wheels as a way to vary an amount of rotational power being delivered to the wheel or wheels by the electric motor. As discussed above, the field produced by the magnets may extend in a direction generally parallel to the direction of the electric current (in one form) or in a direction generally perpendicular to the direction of the electric current (in another form). In the first configuration, the creation of the Lorentz force on the contact plate is substantially non-existent, while in the second it acts upon the contact plate is in the direction that does not substantially promote premature separation of the contact plate from the terminals.

According to another aspect of the invention, a method of operating a switching assembly is disclosed. The method includes disposing a contact plate adjacent electrically-conductive terminals and operating a solenoid. When the solenoid is energized, it forces the contact plate into contact with the terminals to complete an electric circuit Likewise, when the solenoid is de-energized, it permits the contact plate to separate from the plurality of terminals to open (i.e., disable) the electric circuit. The switching assembly also includes numerous arc-extinguishing magnets disposed about a region defined at least in part by the contact points. In this way, it operates substantially as described in the previously-discussed aspects of the invention.

In one optional form, the switching assembly is made as at least a part of an automotive relay. The electric circuit forms a portion of a power circuit that may include numerous electric batteries and wiring configured to convey electric current from the electric batteries to a motive force through the relay. As discussed above, one example of such a motive force is an electric motor that is rotationally coupled to one or more vehicular wheels. In one preferred form, the batteries are lithium-ion batteries. As discussed above, the field produced by the plurality of magnets may be made to extend in a direction generally parallel to the direction of electric current flowing through the electric circuit such that creation of the Lorentz force onto the contact plate is substantially inhibited, or in a direction generally perpendicular to the direction of electric current flowing through the electric circuit. In either configuration, no action of a Lorentz force can promote premature separation of the contact plate from the plurality of terminals. In one form, the solenoid and the contact plate are affixed to one another such that movement of a solenoid component (such as a plunger that moves in response to a field set up in the solenoid's coil) forces the contact plate toward or away from the terminals, depending on whether the solenoid id being energized or de-energized.

BRIEF DESCRIPTION OF THE DRAWINGS

The following detailed description of specific embodiments can be best understood when read in conjunction with the following drawings, where like structure is indicated with like reference numerals and in which.

DETAILED DESCRIPTION OF THE PREFERRED EMBODIMENTS

Figure 1A:
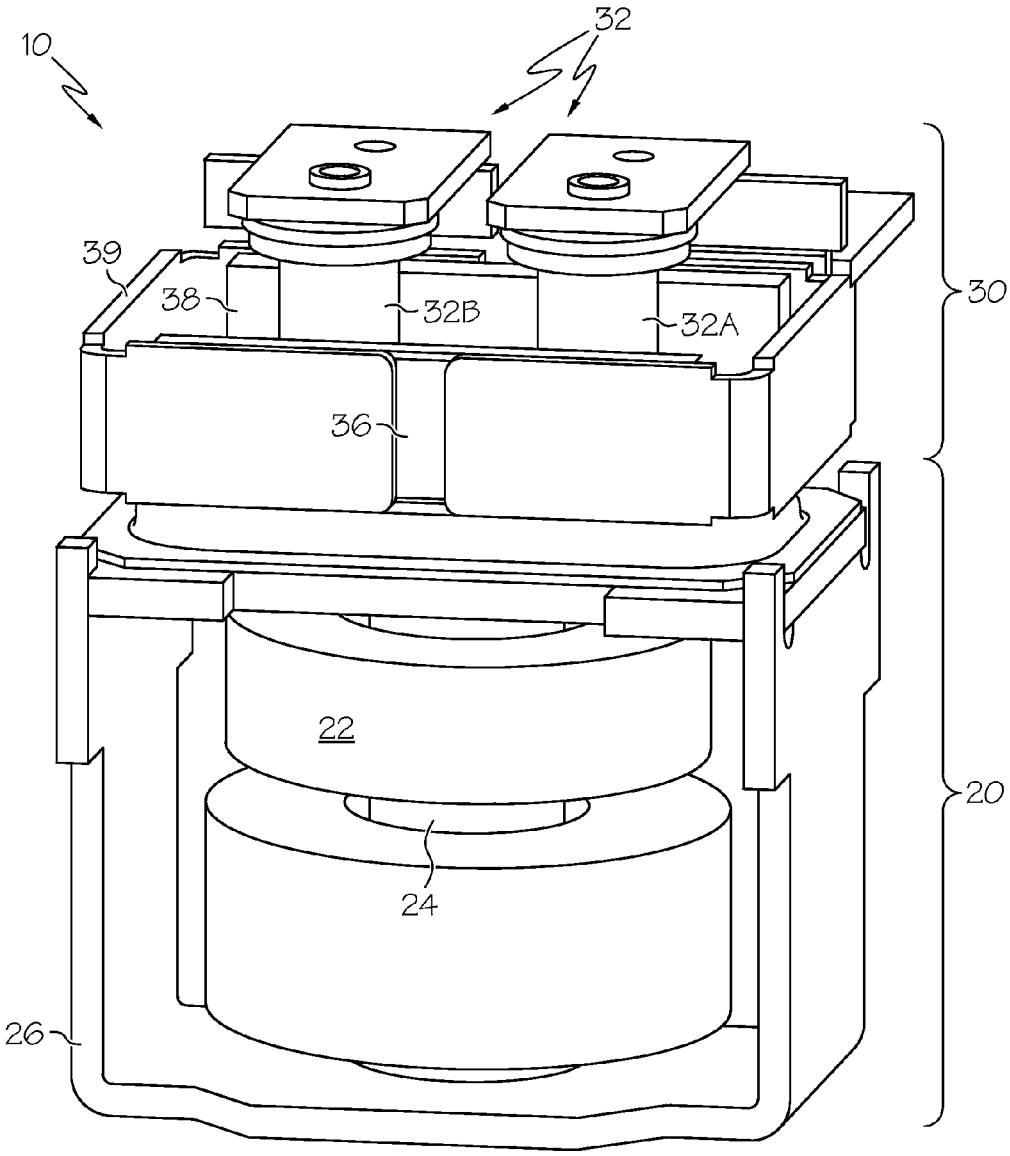
FIG. 1A (PRIOR ART)
FIG. 1A shows a perspective view of a typical linearly-actuated electrical relay according to the prior art.
Figure 1B:
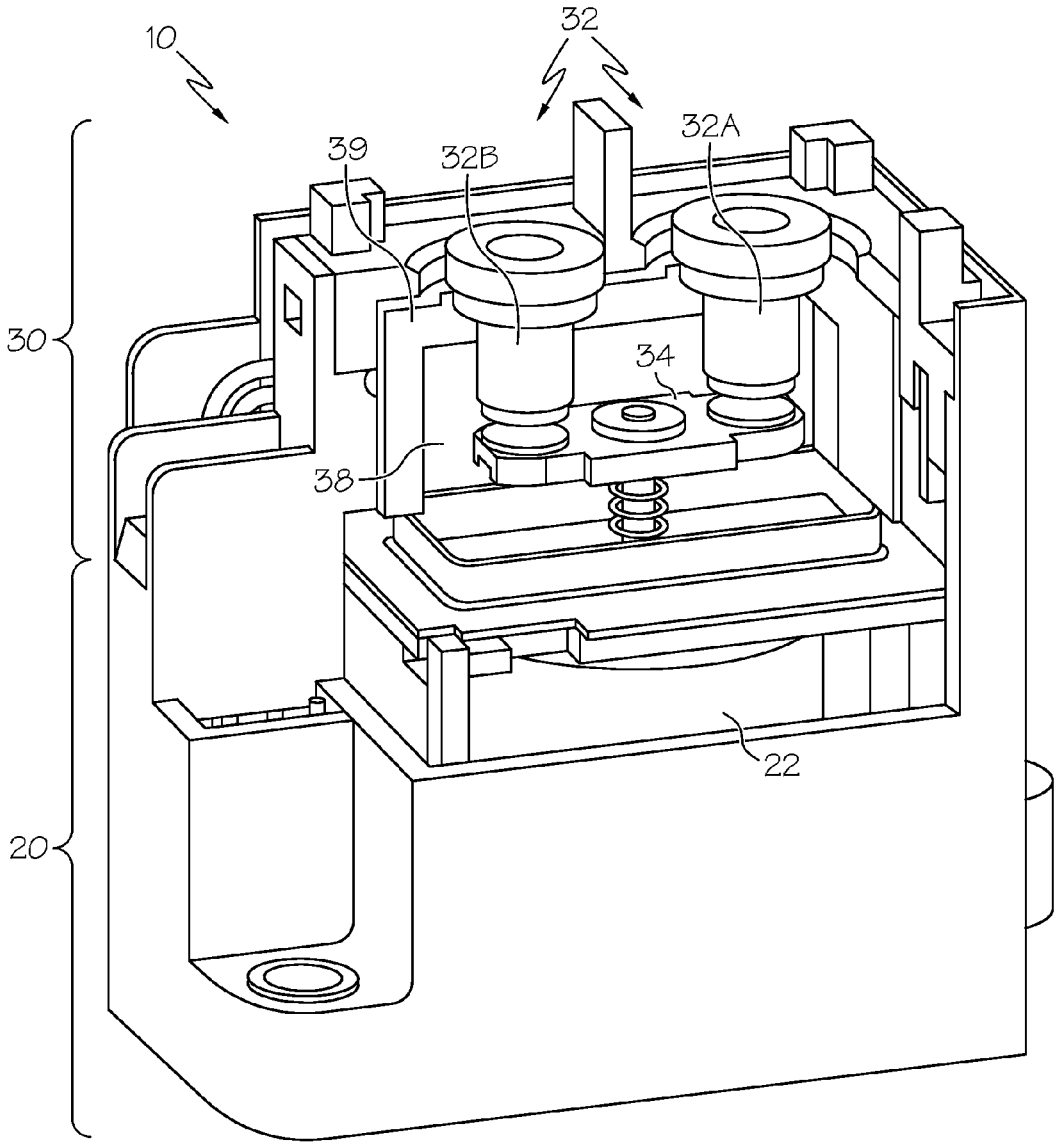
FIG. 1B (PRIOR ART)
FIG. 1B shows a partial cutaway view of the electrical relay of FIG. 1A, highlighting the linear configuration of the contact portion.

As discussed above, arcing at the opening contactor portion of a linear switching assembly (such as a relay) can have a deleterious effect on the assembly and adjacent components. Depending on the configuration of the switching assembly, as well as the voltage and current flowing through the circuit, such arcing occurs very promptly, often on the order of a few hundred microseconds Likewise, prior art approaches have included placing magnets adjacent a contactor portion that includes the contact plates and terminals used to establish a high voltage contactor. Referring first to FIGS. 1A and 1B, a conventional relay 10 (which may also be in the form of a cutout, circuit breaker or related switch) is outfitted with arc-extinguishing magnets 36, 38 (discussed in more detail below). Relay 10 includes a solenoid portion 20 and a contactor portion 30. The solenoid portion 20 includes one or more coils 22 that, when energized, generate a magnetic flow that will longitudinally move an enclosed core, shaft or plunger 24 that is placed within the coil 22. The coil 22 and plunger 24 are enclosed within a magnetizable yolk or field 26 that acts to strengthen the magnetic flow. The contactor portion 30 is shown at the top and generally includes of a pair of terminals 32 and a moving-contact plate 34 that is connected to the top of plunger 24. The contact plate 34 selectively attaches and detaches from the terminals 32 depending on whether the solenoid portion 20 is energized or de-energized. Thus, when the coil 22 is energized, plunger 24 pushes upward and forces contact between the contact plate 34 and the terminals 32, allowing electric current to flow from one terminal to another Likewise, when coil 22 is not energized, the plunger is retracted under spring biasing means back into the coil 22 such that the high voltage contactor portion 30 will be in an open status.

Figure 4A:
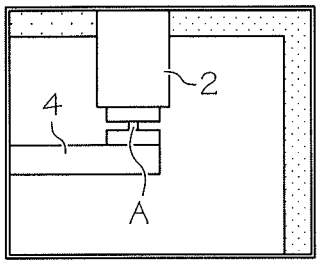
FIG. 4A (PRIOR ART)
FIGS. 4A through 4E show the formation and growth of an arc.
Figure 4B:
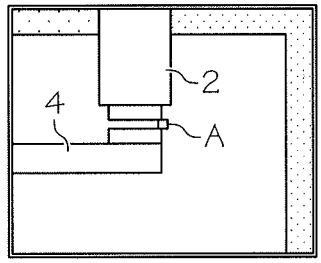
FIG. 4B (PRIOR ART)
Figure 4C:
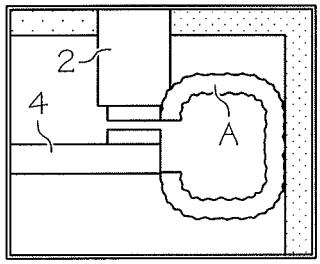
FIG. 4C (PRIOR ART)
Figure 4D:
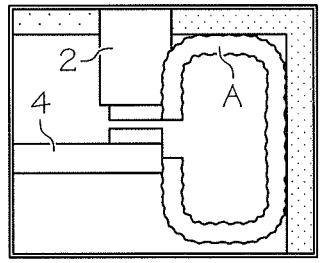
FIG. 4D (PRIOR ART)
Figure 4E:
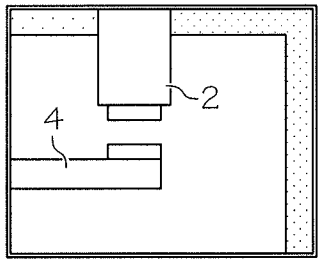
FIG. 4E (PRIOR ART)

Referring next to FIGS. 4A through 4E, the mechanisms behind arcing formation are shown in sequence. In FIG. 4A, the arcing starts at the gap that is formed as the terminals 32 pull away from the contact plate 34. FIG. 4B shows that the arc shifts outward under the influence of the magnetic field that is created by the magnets 36 and 38. FIG. 4C shows that the arc is expanding once the arcing voltage is increased. FIG. 4D shows the effect of the ambient atmosphere on the arc, as the cooling effect of the atmosphere causes the voltage to further increase. Lastly, FIG. 4E shows that when the arcing voltage is equal to or greater than the voltage between contacts, the arc will be extinguished.

By the construction of the relay 10 from FIGS. 1A and 1B, the direction of electric current flow through the contact plate 34 is oriented such that it operates along a direction that is orthogonal to that of the magnetic field that extends between the north and south poles of each of the magnets 36 and 38. In this way, and keeping in mind that the force $\vec{F}$ generated is generally related to the interaction of the magnetic field $\vec{B}$ and the current $\vec{I}$ by the vector quantity $$\vec{F}=\vec{I}\times\vec{B},$$

the resulting Lorentz force is oriented along a direction that is substantially orthogonal to the plane of cooperation between the current $\vec{I}$ and magnetic field $\vec{B}$. This orthogonal interaction between the magnetic field formed by magnets 36 and 38 and the current flow through terminals 32 (shown presently as rightmost terminal 32A and leftmost terminal 32B) produces two different imparted forces, depending on the direction of the current flow $\vec{I}$.

Figure 2:
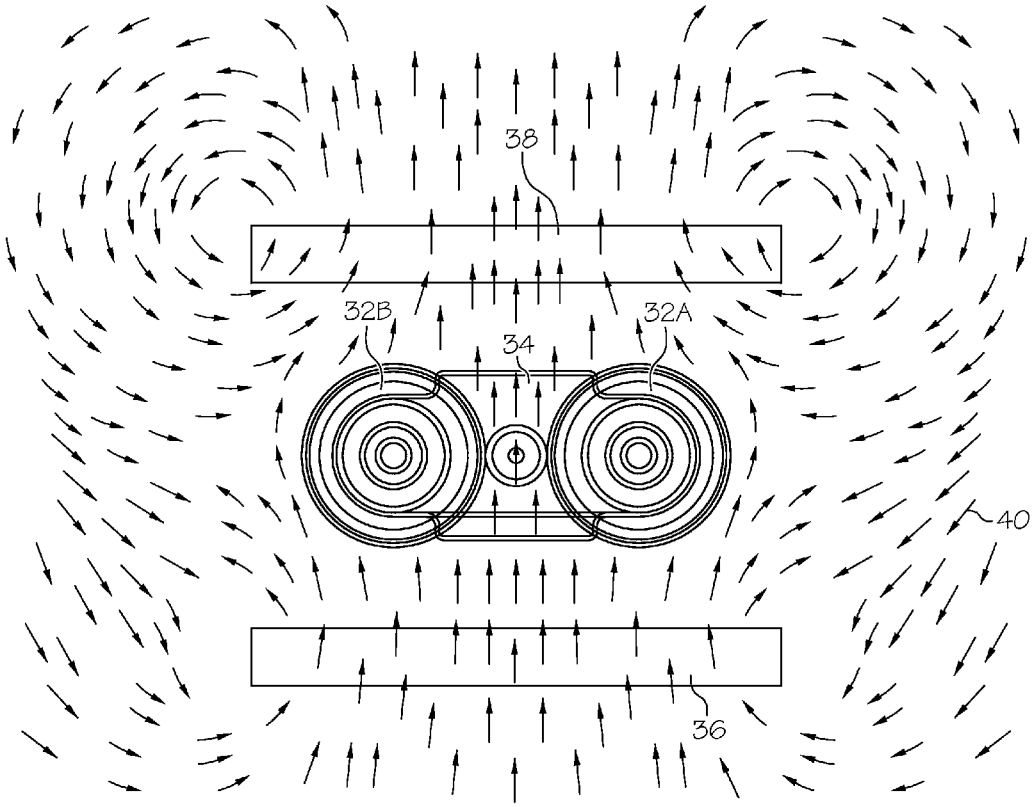
FIG. 2 (PRIOR ART)
FIG. 2 shows a top view of a representative magnetic field generated by the relay of FIGS. 1A and 1B.
Figure 3A:
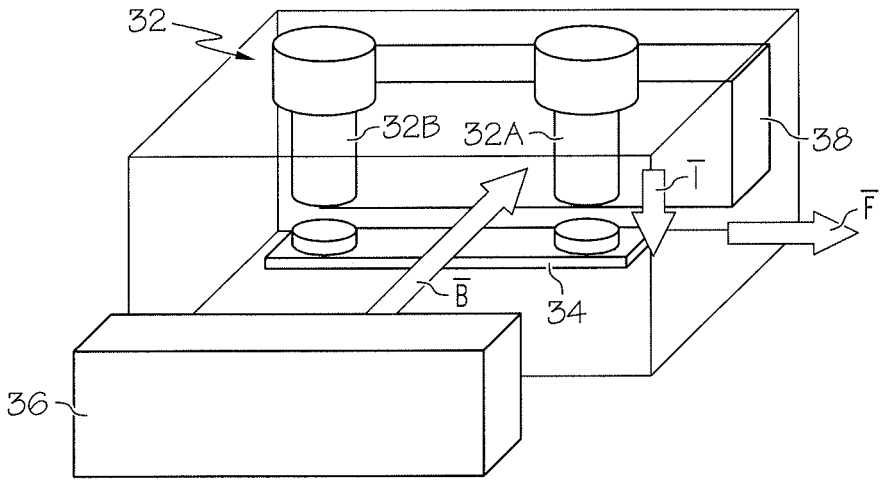
FIG. 3A (PRIOR ART)
FIG. 3A shows how an outwardly-directed Lorentz force produced by the relationship between electric current and magnetic field can be used to suppress an arc formed during a period immediately after the circuit connected by a linear relay has been disrupted.

Referring next to FIGS. 2 and 3A, to correct arcing shown in FIGS. 4A through 4E that occurs when high-voltage solenoid contacts open, magnets 36, 38 are placed adjacent a contact portion that includes the contact plates and terminals used to establish a high voltage contactor. The pair of magnets 36 and 38 are placed astride the terminals 32 such that a magnetic field 40 engulfs contact portion 30. A frame 39 is used to securely mount the magnets 36 and 38 to the yoke 26, in addition to helping to define a region around the terminals 32 and contact plate 34 where the magnetic filed is most pronounced. In the version depicted in the figures, magnet 36 corresponds to a north pole, while magnet 38 corresponds to a south pole such that a N-S bipolar relationship exists between them, although it will be appreciated by those skilled in the art that an opposing polarity could be established. The pair of magnets 36 and 38 are shown placed across the entire length of the contact area formed between the contact plate 34 and the terminals 32, and in fact extend laterally beyond to promote adequate magnetic field size.

As discussed above (and referring with particularity to FIG. 3A), the magnetic field 40 produced by magnets 36 and 38 will force an arc produced upon separation of the terminals 32 and contact plate 34 to expand toward the outside of the surface of the contact area. Such expansion beneficially causes rapid energy dissipation and leads to the arc being quickly extinguished as the result. This orthogonal interaction between the magnetic field formed by magnets 36 and 38 and the current flow through terminals 32 produces the outward-directed force that tends to shorten the arcing duration, and is a generally desirable byproduct of the interaction of the electric current flowing through the terminals and the magnetic field passing between the supplemental magnets. Because the residual current $\vec{I}$ is flowing downward in the rightmost terminal 32A and upward in the leftmost terminal 32B, the interaction with the magnetic field $\vec{B}$ produces a rightward force from the rightmost terminal 32A and a leftward force from the leftmost terminal 32B, thereby (in both cases) pushing the arc (not shown) outward such that its energy can dissipate more quickly. As such, this force tends to shorten the arcing duration, and is (as mentioned above) a generally desirable byproduct of the interaction of the electric current flowing through the terminals and the magnetic field passing between the magnets.

Figure 3B:
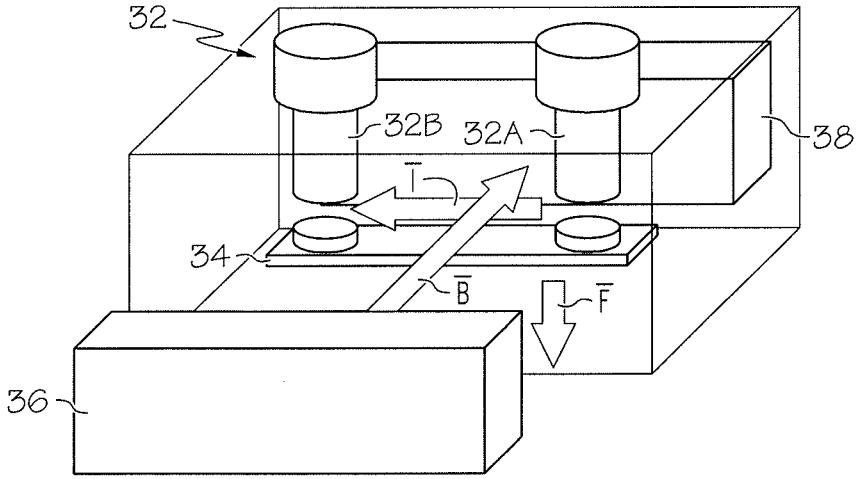
FIG. 3B (PRIOR ART)
FIG. 3B shows how a Lorentz force produced by the relationship between electric current and magnetic field during normal circuit operation has a downwardly-directed component that may operate on a linear relay's contact plate.

While helpful in extinguishing any arcs that may form upon contact opening, the magnets 36 and 38 also generate Lorentz force on the linearly-reciprocating contact plate 34. This is shown in FIG. 3B. Under certain operating conditions (especially those associated with high-power sources, such as those used to propel an automobile or related vehicle), a higher-than-expected current may be encountered, causing the Lorentz force to become large enough to move the plate 34 downwardly, thereby opening the contact between it and the terminals 32. In the situation shown in FIG. 3B (which may coincide with a period of normal circuit operation up to and including the period just before the circuit is opened), the Lorentz force $\vec{F}$ is shown acting on the contact plate 34 on which the current $\vec{I}$ flows in the right-to-left direction and the magnetic field $\vec{B}$ is as before. The resulting force $\vec{F}$ will be in the downward direction, which could undesirably operate upon the contact plate 34 by forcing it to open prematurely. It is this situation that the present inventors have determined should be avoided, at least for circumstances where there is linear coupling between the terminals and the contact plate.

Figure 5A:
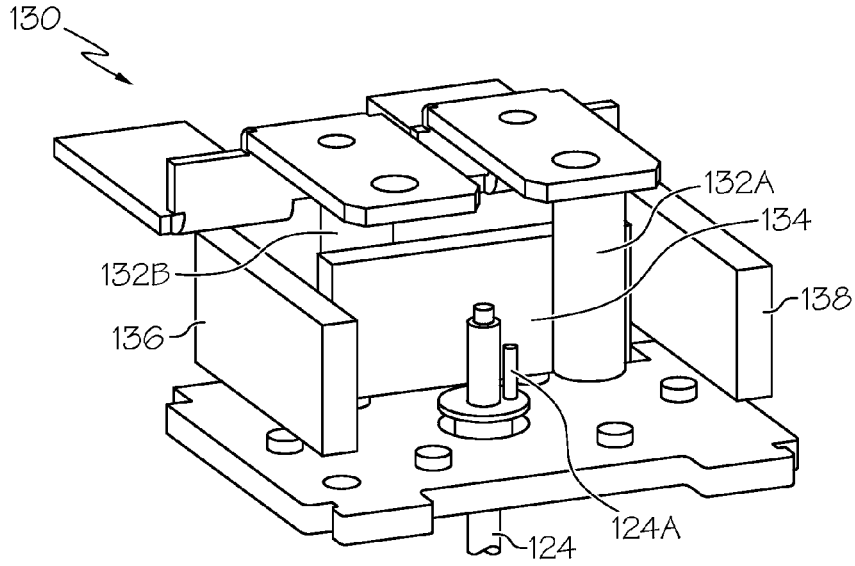
FIG. 5A shows a perspective view of a contact portion of a rotary electrical relay according to an aspect of the present invention.
Figure 5B:
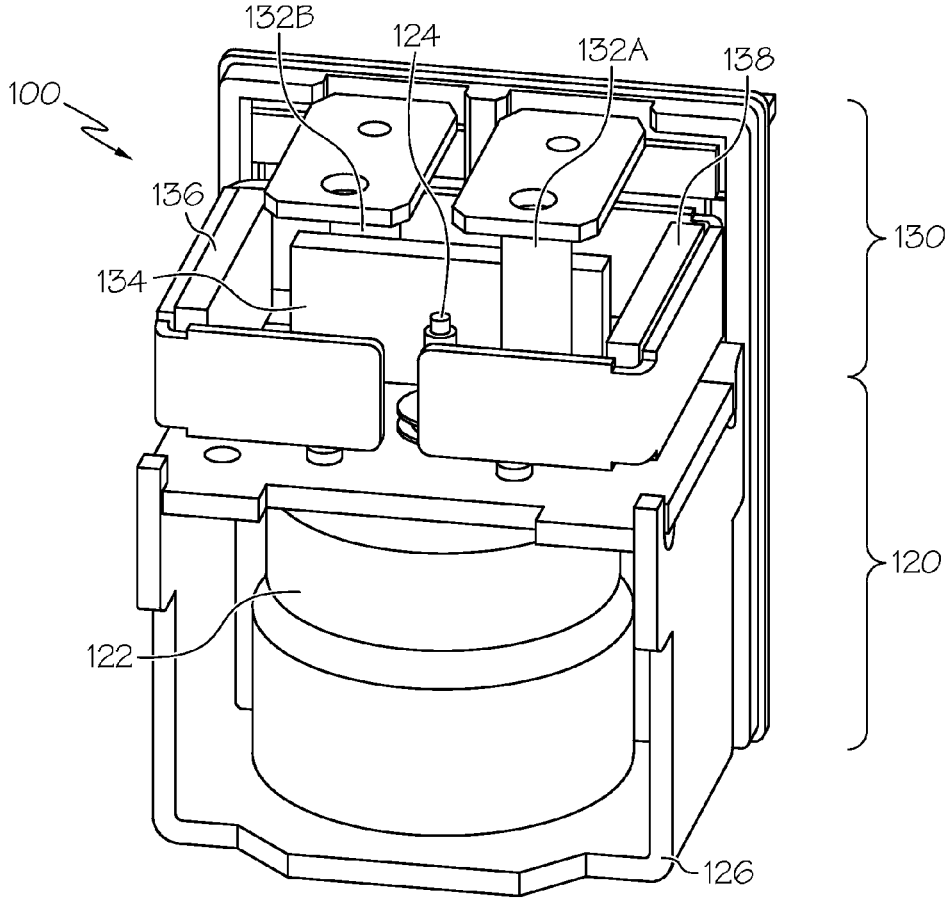
FIG. 5B shows a rotary electrical relay incorporating the contactor portion of FIG. 5A.

The present inventors have determined that a configuration where there is linear coupling between the terminals and the contact plate should be avoided. Referring next to FIGS. 5A and 5B, the present invention employs a rotary contact portion 130 that allows rapid arc extinguishing while simultaneously reducing the Lorentz force. Relay 100 includes a contact portion 130 that houses the high voltage contactor made up of terminals 132 (labeled individually as 132A and 132B in a manner generally similar to that of FIGS. 1A, 1B, 3A and 3B) and contact plate 134 such that a free-spinning (i.e., rotating) plunger 124 cooperates with a contact plate 134 to establish selective electrical connection between the two terminals 132. As such, plunger 124 acts like a cap sitting on top of the solenoid portion's 120 shaft so it can rotate freely, and as such does not rigidly link to the shaft that is responsive to the current that passes through the coils 122. Unlike the device shown in FIG. 2A, the plunger 124 is not used to establish the selective contact between the individual terminals 132A and 132B. Instead, the collar 124A (which is connected to the solenoid portion 120) makes intermittent contact with contact plate 134. When the solenoid portion 120 is energized, it rotates the collar 124A clockwise, which will in turn touch and rotate contact plate 134 clockwise. When the solenoid portion 120 is de-energized, the collar 124A will rotate counter-clockwise, then a spring (not shown, but could, for example, be a rotary type of spring) will then to utilized to push the contact plate 134 back or counter-clockwise.

Referring with particularity to FIG. 5B, the supplemental magnets 136 and 138 are placed on opposing sides of yolk (or field) 126 such that terminals 132, contact plate 134 and the uppermost extension of plunger 124 are resident within the field created by the north-south poles of the magnets 136 and 138. Unlike the linear variant shown and described above, the plunger 124 is rotated to establish the electrically-continuous connection between the two terminals 132. In this configuration, the contact plate 134 faces a generally horizontal (rather than vertical) orientation. Also unlike a linear variant, the supplemental magnets 136 and 138 are placed such that a magnetic field formed between them is substantially aligned with the direction of current through the contact plate 134 during normal closed-circuit operation. As with the linear variants, the electrical contact is maintained for such time as the solenoid portion 120 remains energized.

Figure 6:
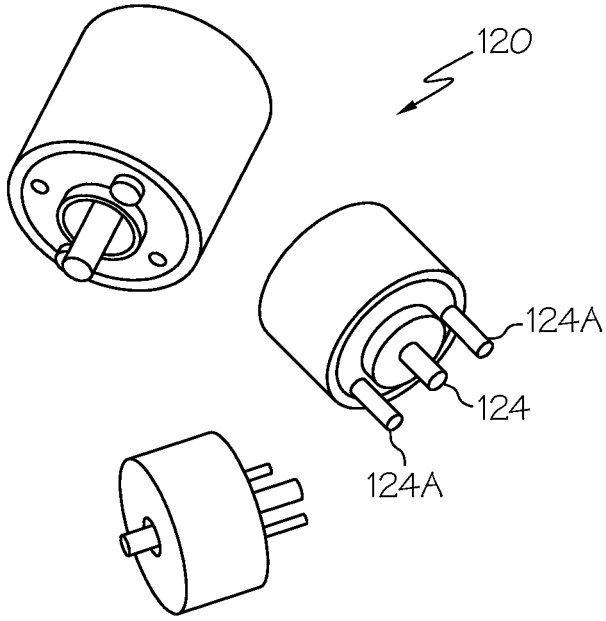
FIG. 6 shows representative rotary solenoids incorporating a rotating plunger according to an aspect of the present invention.
Figure 7:
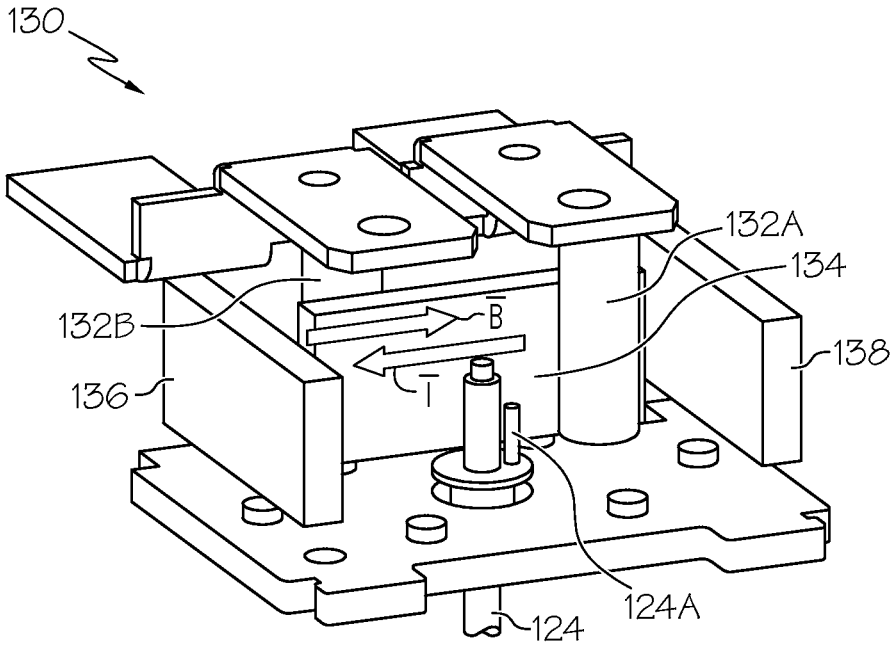
FIG. 7 shows how a Lorentz force is minimized by the configuration of FIGS. 5A and 5B.

FIG. 6 shows that a solenoid portion 120 made with a rotary contact design may be made in various shapes and sizes, depending on the application. In such a configuration, solenoid portion 120 includes at least a coil and a plunger that is rotatably responsive to electric current flowing through the coil so that the operation of the rotary solenoid portion 120 is such that actuation of plunger 124 rotates rather than translates. As such, by coupling contact plate 134 to plunger 124, it too moves with a generally rotational motion. Because the two terminals 132 are situated within a path defined by the arc of rotation of contact plate 134, the generally opposing ends of contact plate 134 will make contact with respective ones of the two terminals 132. This in turn completes (i.e., closes) the electric circuit, permitting current to flow. FIG. 7 shows that by causing the current flow through the two terminals 132 and contact plate 134 to be in a direction parallel to that of the north-south magnetic field between magnets 136 and 138, the Lorentz force generated during normal closed-circuit operation is substantially eliminated insofar as maximum Lorentz forces are generated when the magnetic field and electrical current are orthogonal to one another. As such, this presently-shown parallel alignment results in little or no coupling, and hence little or no Lorentz force generation. In addition to giving designers the freedom to position the magnets in two different fashions without letting the Lorentz force interfere with the normal operation, the present rotary design allows for a fast open and close operation of the contact plate, as well as efficient arc-breaking.

While certain representative embodiments and details have been shown for purposes of illustrating the invention, it will be apparent to those skilled in the art that various changes may be made without departing from the scope of the invention, which is defined in the appended claims.

What is claimed is:

1. A vehicular propulsion system comprising:
- a plurality of batteries;
- a motive force; and
- a switching assembly configured to permit selective delivery of an electric current from said plurality of batteries to said motive force, said switching assembly comprising:
  - a solenoid comprising at least a coil and a plunger rotatably responsive to electric current flowing through said coil;
  - a contact plate;
  - a plurality of electrically-conductive terminals cooperative with said solenoid and said contact plate such that upon said solenoid being energized, rotational movement of said plunger forces said contact plate into contact with said plurality of terminals to complete an electric circuit therebetween; and a plurality of arc-extinguishing magnets disposed about a region defined at least in part by said contact between said contact plate and said plurality of terminals such that a field created by said plurality of magnets extends in a direction such that a Lorentz force formed by coupling between said field and a current flow between said plurality of terminals during said contact between said contact plate and said plurality of terminals is substantially inhibited or formed along a direction that does not substantially promote premature separation of said contact plate from said plurality of terminals.

2. The propulsion system of claim 1, wherein said plurality of batteries comprise a plurality of lithium-ion batteries.

3. The propulsion system of claim 1, wherein said motive force comprises an electric motor that is rotationally coupled to at least one vehicular wheel.

4. The propulsion system of claim 3, further comprising a vehicular transmission disposed between said electric motor and said at least one vehicular wheel in order to vary an amount of rotational power being generated by said electric motor to said at least one vehicular wheel.

5. The propulsion system of claim 1, wherein said field produced by said plurality of magnets extends in a direction generally parallel to the direction of said electric current such that creation of said Lorentz force onto said contact plate is substantially inhibited.

6. The propulsion system of claim 1, wherein said field produced by said plurality of magnets extends in a direction generally perpendicular to the direction of said electric current such that said created Lorentz force acts upon said contact plate in said direction that does not substantially promote premature separation of said contact plate from said plurality of terminals.

* * * * *